United States Patent [19]

Delin

[11] Patent Number: 5,015,198

[45] Date of Patent: May 14, 1991

[54] TERMINAL FOR CONNECTING AN INSULATED BRANCH CONDUCTOR TO AN INSULATED OVERHEAD LINE CONDUCTOR

[75] Inventor: Michel Delin, Rieux, France

[73] Assignee: Niled S.A., Rieux, France

[21] Appl. No.: 449,425

[22] Filed: Dec. 14, 1989

Related U.S. Application Data

[63] Continuation of Ser. No. 337,308, Apr. 13, 1989, abandoned.

[30] Foreign Application Priority Data

Apr. 27, 1988 [FR] France ..... 88 05615

[51] Int. Cl.[5] ..... H01R 4/24

[52] U.S. Cl. ..... 439/411

[58] Field of Search ..... 439/389-425

[56] References Cited

U.S. PATENT DOCUMENTS

| | | | |
|---|---|---|---|
| 3,848,956 | 11/1974 | Kraft | 439/411 |
| 4,643,512 | 2/1987 | Prodel | 439/412 |
| 4,684,196 | 8/1987 | Smith et al. | 439/411 |

FOREIGN PATENT DOCUMENTS

| | | |
|---|---|---|
| 384123 | 10/1987 | Austria . |
| 3125629 | 2/1983 | Fed. Rep. of Germany . |
| 2566191 | 12/1985 | France . |

*Primary Examiner*—Joseph H. McGlynn

*Attorney, Agent, or Firm*—Sandler, Greenblum & Bernstein

[57] ABSTRACT

A terminal for connecting an insulated branch conductor to an insulated overhead line conductor includes two pairs of contact bars each of which bars has on the side facing towards another contact bar near one end teeth piercing the insulation of the overhead line conductor and near the other end teeth piercing the insulation of the branch conductor. Two insulative material half-shells each define at least two parallel housings each of which receive a respective contact bar. A resilient gasket is placed between the half-shells. It is made in one piece and defines a laterally open first conduit passing over the overhead line conductor and a second conduit receiving the branch conductor. The first and second conduits comprise respective slots for the teeth to pass through. The half-shells are coupled together in a way which allows relative sliding and pivoting. There is a tapered hole in one of the half-shells, a screwthread in the other half-shell and a screw which passes through the tapered hole and is screwed into the screwthread to clamp the half-shells together. By virtue of this arrangement the resilient gasket tends to hold the terminal in a position which facilitates fitting it to the overhead line conductor while the branch conductor is held in the second conduit, and when the two half-shells are clamped together the gasket provides a seal along the slots through which the contact bar teeth pass.

5 Claims, 2 Drawing Sheets

TERMINAL FOR CONNECTING AN INSULATED BRANCH CONDUCTOR TO AN INSULATED OVERHEAD LINE CONDUCTOR

This application is a continuation of application Ser. No. 07/337,308, filed Apr. 13, 1989 now abandoned.

BACKGROUND OF THE INVENTION

1. Field of the invention

The present invention concerns a terminal for connecting an insulated branch conductor to an insulated overhead line conductor.

2. Description of the prior art

Terminals comprising two insulative material half-shells joined together by a clamping screw are known. Each half-shell features two channels facing each other and one of which is adapted to receive the overhead line conductor while the other is adapted to receive the branch conductor. Recessed into each half-shell is a housing adapted to receive a contact bar which extends from one channel to the other and which is provided with teeth projecting into each channel so that when the two half-shells are clamped up by the screw the teeth pierce the insulations of the two conductors and so make the electrical connection.

Branch connection terminals of this kind have a number of disadvantages. The connection obtained in this way is not fluid-tight which is an important long-term disadvantage. Fitting the terminal is not particularly easy, as it is necessary to separate the two half-shells from each other, to fit them to the conductors and to fasten them together with the screw provided for this purpose.

One object of the present invention is to remedy these disadvantages and to provide a terminal which is entirely secure from the fluid-tightness point of view and which is much simpler and more practical to use than known terminals.

SUMMARY OF THE INVENTION

The present invention consists in a terminal for connecting an insulated branch conductor to an insulated overhead line conductor comprising at least two pairs of contact bars each of which bar has on a side adapted to face towards another contact bar near one end teeth adapted to pierce the insulation of the overhead line conductor and near the other end teeth adapted to pierce the insulation of the branch conductor, two insulative material half-shells, at least two parallel housings in each half-shell each adapted to receive a respective contact bar, a resilient gasket adapted to be placed between said half-shells, made in one piece and defining a laterally open first conduit adapted to pass over the overhead line conductor and a second conduit adapted to receive the branch conductor, said first and second conduits comprising respective slots for said teeth to pass through, coupling means for said half-shells adapted to enable relative sliding and pivoting of said half-shells, a tapered hole in one of said half-shells, a screwthread in the other half-shell and a screw adapted to pass through said tapered hole and to be screwed into said screwthread to clamp said half-shells together. By virtue of this arrangement, the resilient gasket tends to hold the terminal in a position which facilitates fitting it to the overhead line conductor while the branch conductor is held in the second conduit, and when the two half-shells are clamped together the gasket provides a seal along the slots through which the contact bar teeth pass.

According to a preferred characteristic of the invention directed to improving the seal further, the terminal further comprises beads on said gasket flanking said slots and corresponding notches in said half-shells adapted to cooperate with said beads.

The gasket preferably comprises a resilient flexible bar and a cap carried by said bar. The free end of the branch conductor may then be protected by fitting said cap over it.

In a preferred embodiment of the invention one of said half-shells comprises on each of two opposite side walls a respective hoop member and the other half-shell comprises on its corresponding walls respective arc members adapted to cooperate with said hoop members. This provides a particularly simple way to join the two half-shells together in such a way that they can nevertheless slide and pivot relative to each other.

Another disadvantage of the prior art technique is that, if the screw which urges the two half-shells towards each other is overtightened, the conductors may be damaged whereas if the screw is not tightened sufficiently the electrical connection may not be made.

Another preferred feature of the invention makes it possible to remedy this disadvantage in that said screw comprises a head including means for engagement with a wrench, a weaker section whereby said head is joined to the remainder of said screw so that on application of a predetermined torque to said head it is separated from the remainder of said screw, and, adjacent said head, a part adapted to be engaged with a tool in the form of flats with dimensions greater than the dimensions of said head. Because the part with flats is slightly larger than the head, the wrench used to tighten the screw and cooperating with the head is not able to slide onto said part with flats and it is therefore certain that when the clamping torque is reached the head will separate from the body of the screw.

The invention will now be described in more detail and by way of example only with reference to a specific embodiment shown in the appended drawings.

DESCRIPTION OF THE PREFERRED EMBODIMENT

Figure 1:
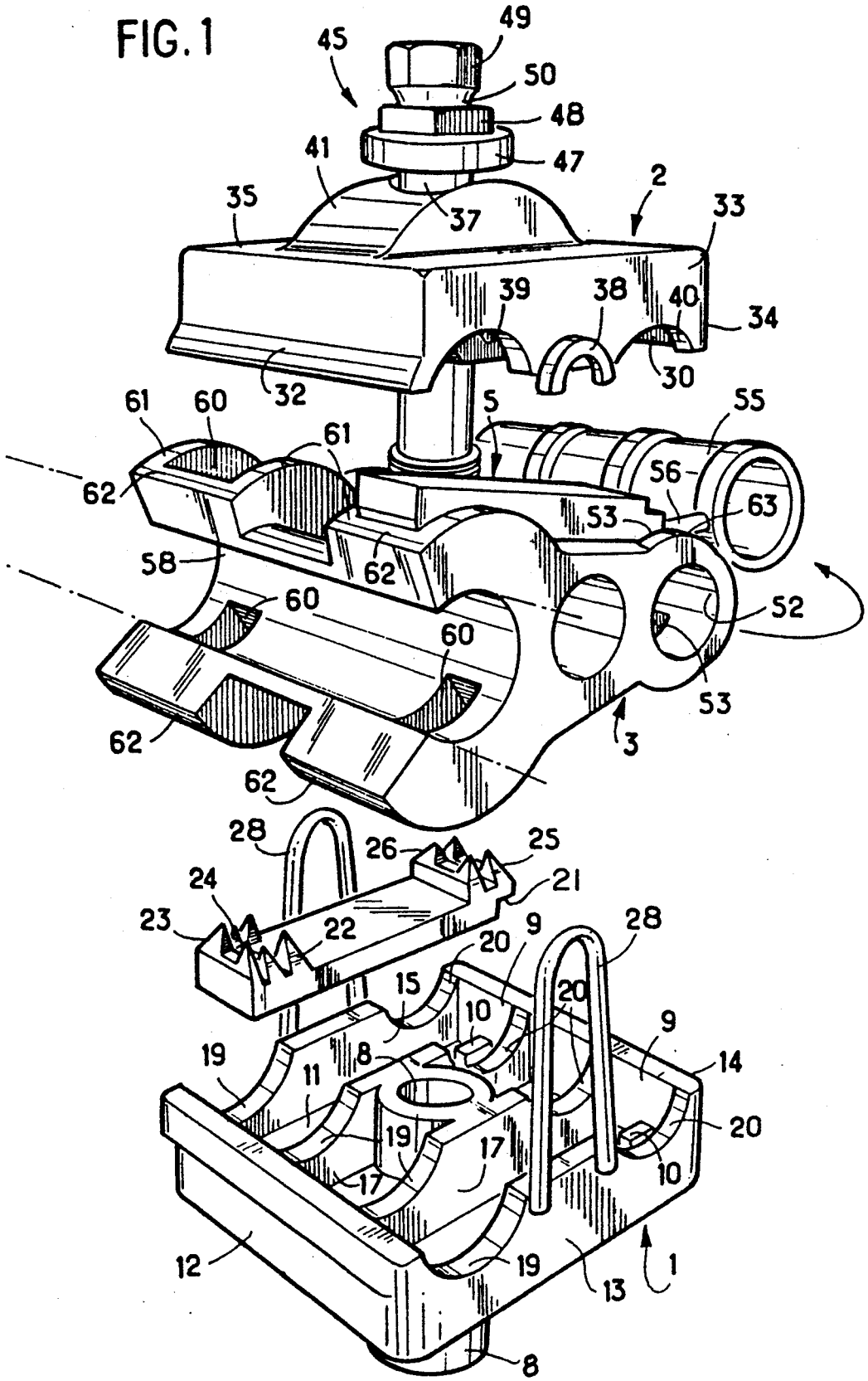
FIG. 1 is an exploded view in perspective of a branch connection terminal in accordance with the invention.

The terminal shown in the figures is designed to make a branch connection from an insulated overhead line conductor.

The terminal comprises a first half-shell 1, a second half-shell 2, a gasket 3 and four contact bars 5.

The half-shell 1 is made from an electrically insulative material and is in the form of a body comprising a bottom 11 and four side walls 12, 13, 14 and 15. In the central part of the bottom 11 is a blind hole 7 formed with a screwthread 8. Parallel to the walls 13 and 15 are two partitions 17 which define with said walls two housings 9.

Each housing 9 has a projection 10 near one end.

The walls 13 and 15 each comprise a wide notch 19 and a narrow notch 20, corresponding notches being formed in the partitions 17.

Each housing 9 is adapted to receive a bar 5 which is made from a material that is a good electrical conductor and is in the shape of a parallelepiped with at one end on one side a notch 21 corresponding to the projection 10 and on the side opposite that provided with said notch 21 three teeth 22, 23 and 24 at one end and two teeth 25 and 26 at the other end.

The sides 13 and 14 each have a hoop member 28 attached to them.

The second half-shell is made from an insulative material and its general shape is substantially similar to that of the first half-shell 1. It has four side walls 32, 33, 34 and 35, each of the walls 33 and 35 comprising a wide notch 39 corresponding to the notches 19 and a narrow notch 40 corresponding to the notches 20.

The central part of the exterior of the half-shell 2 has a rounded swelling 41 through which passes an axial hole 37 which diverges from the interior of said half-shell 2 towards the upper end of the swelling 41.

The half-shell 2 comprises internally housings 30 corresponding to the housings 9 and provided in the vicinity of the wall 34 with a projection (not visible in the drawings) identical to the projections 10.

The walls 33 and 35 each comprise in their central part an arc member 38 projecting slightly and adapted to cooperate with the ends of the hoop members 28.

The axial hole 37 is adapted to have a screw 45 for fastening the half-shells 1 and 2 together passed through it. The screw 45 has at one end a screwthread 46 adapted to cooperate with the screwthread 8 of the blind hole 7 and at the other end a flange 47 adapted to cooperate with the swelling 41, the flange being extended via a weaker section 50 by a part 48 with flats in turn extended by a hexagonal head 49.

The screw 45 is made from zamak alloy, for example, and the screwthread 46 has a shape which in conjunction with the screwthread 8 avoids flexing and shearing of the threads of said screwthread.

The part 48 with the flats is made in such a way that a wrench fitted over the hexagonal head 49 cannot simultaneously cooperate with said part 48 with the flats.

The gasket 3 is made from a resilient flexible material and comprises a conduit 52 through which are four slots 53 designed to have the teeth 25 and 26 on the four bars 5 passed through them, two of the bars being disposed in the housings 9 and the other two in the housings 30. The conduit 52 is adapted to receive an insulated branch conductor 57 the free end of which is adapted to project from one end of said conduit and to receive a cap 55 connected to the gasket by a resilient flexible bar 56. The cap 55 is frustoconical so that the free end of the conductor is a force fit in said cap and is protected thereby.

The gasket 3 comprises in its central part a hole (not visible in the drawings) for the screw 45 to pass through and a second C-shaped cross-section conduit 58 comprising four slots 60 adapted to have the teeth 22, 23 and 24 of the corresponding four bars passed through them.

The conduit 58 is adapted to receive an insulated overhead line conductor and by virtue of the lateral opening the terminal may readily be fitted onto said conductor 70.

The slots 60 are flanked externally by beads 61 which are adapted to cooperate with the notches 19 in the half-shell 2 and the notches 39 in the half-shell 1. The edges 62 adjacent the lateral opening of the conduit 58 are adapted to cooperate with the free edges of the walls 12 and 32.

The slots 53 are similarly flanked externally by beads 63 adapted to cooperate with the notches 20 and 30.

Figure 2:
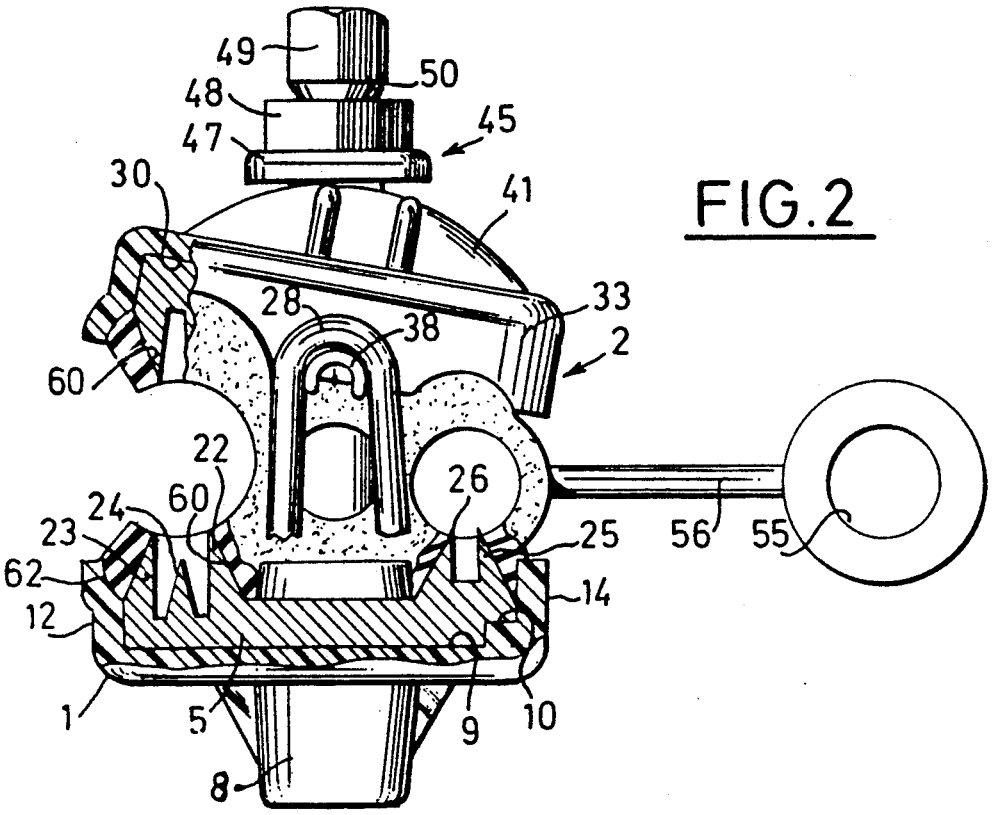
FIG. 2 is a view in elevation of the assembled terminal from FIG. 1.
Figure 3:
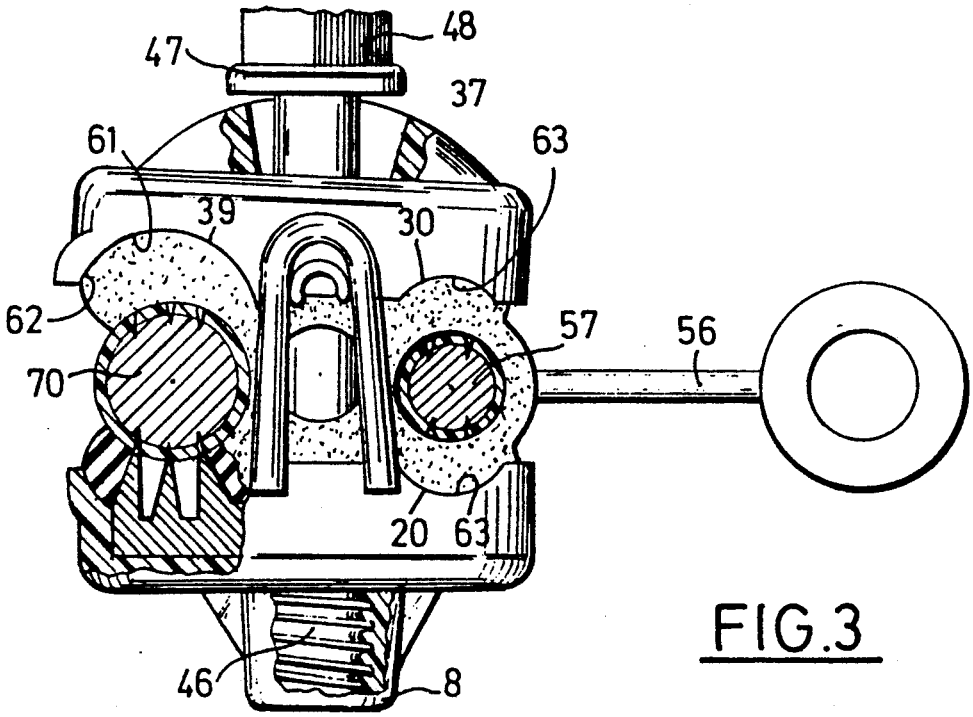
FIG. 3 is a view in elevation showing the terminal when affixed.

The terminal is supplied in the assembled state as shown in FIG. 2 with the gasket 3 holding the two half-shells 1 and 2 in a position ready for use. The arc members 38 cooperate with the ends of the hoop members 28 to provide both an abutment whereby the two half-shells are coupled together and an articulation.

The terminal is fitted by inserting the conductor 70 into the conduit 58, the branch conductor 57 being fitted into the conduit 52 with its free end protected by the cap 55; the screw 45 is then tightened using a wrench cooperating with the hexagonal head 49 until the latter breaks off at the weaker portion 50. During this tightening the teeth 22, 23 and 24 pierce the insulation of the conductor 70 and the teeth 25 and 26 pierce the conductor 57 after piercing its insulation so that the electrical connection between the two conductors is made. As the terminal is clamped up the beads of the gasket 3 are compressed around the slots to provide a seal.

If it becomes necessary to demount the terminal the screw 45 can be unscrewed using a wrench cooperating with the part 48 with the flats.

Of course, the invention is not limited to the embodiment that has just been described and shown. Numerous modifications of detail may be made thereto without departing from the scope of the invention.

There is claimed:

1. Terminal for connecting an insulated branch conductor to an insulated overhead line conductor comprising at least two pairs of contact bars, each of which contact bar has on a side adapted to face towards another contact bar near one end teeth adapted to pierce the insulation of the overhead line conductor and near the other end teeth adapted to pierce the insulation of the branch conductor; two insulative material half-shells, at least two parallel housings in each half-shell each adapted to receive a respective contact bar; a resilient gasket adapted to be placed between said half-shells, made in one piece and defining a laterally open first conduit adapted to pass over the overhead line conductor and a second conduit adapted to receive the branch conductor, said first and second conduits comprising respective slots for said teeth to pass through; coupling means for said half-shells adapted to enable relative sliding and pivoting of said half-shell; and a tapered hole in one of said half-shells, a screwthread in the other half-shell and a screw adapted to pass through said tapered hole and to be screwed into said screwthread to clamp said half-shells together.

2. Terminal according to claim 1 further comprising beads on said resilient gasket flanking said slots and corresponding notches in said half-shells adapted to cooperate with said beads.

3. Terminal according to claim 1 wherein said resilient gasket includes a resilient flexible bar and a cap carried by said bar.

4. Terminal according to claim 1 wherein one of said half-shells comprises on each of two opposite side walls a respective hoop member and the other half-shell comprises on its corresponding walls respective arc members adapted to cooperate with said hoop members.

5. Terminal according to claim 1 wherein said screw comprises a head including means for engagement with a wrench, a weaker section whereby said head is joined to the remainder of said screw so that on application of a predetermined torque to said head it is separated from the remainder of said screw and adjacent said head a part adapted to be engaged with a tool in the form of flats with dimensions greater than the dimensions of said head.

* * * * *